United States Patent [19]

Meyer

[11] 4,101,236

[45] Jul. 18, 1978

[54] SEALING MANHOLE COVER FOR USE ON EXISTING UNSEALED SANITARY SEWER MANHOLE COVER FRAMES

[75] Inventor: Jack M. Meyer, Neenah, Wis.

[73] Assignee: Neenah Foundry Company, Neenah, Wis.

[21] Appl. No.: 811,019

[22] Filed: Jun. 29, 1977

[51] Int. Cl.[2] ..... E02D 29/14

[52] U.S. Cl. ..... 404/25; 210/163

[58] Field of Search ..... 404/25, 26; 52/20; 210/163, 164

[56] References Cited

U.S. PATENT DOCUMENTS

| | | | |
|---|---|---|---|
| 134,062 | 12/1872 | Ingalls | 404/25 |
| 2,488,796 | 11/1949 | Baier | 404/25 X |
| 2,791,792 | 5/1957 | Shearer | 404/25 X |
| 3,294,000 | 12/1966 | Pelsue | 404/25 |
| 3,308,727 | 3/1967 | Hurt | 404/25 X |
| 3,920,347 | 11/1975 | Sauriol | 404/25 |

*Primary Examiner*—Nile C. Byers

*Attorney, Agent, or Firm*—Wheeler, Morsell, House & Fuller

[57] ABSTRACT

A manhole cover having no openings is provided with a blind pocket for insertion of a lifting tool and has a rectangular O-ring groove in the lower surface to receive a circular O-ring. The groove is so located as to cause the O-ring to engage the flat bearing surface of a conventional manhole cover frame. A complete seal against storm water is afforded.

4 Claims, 3 Drawing Figures

Fig. 1
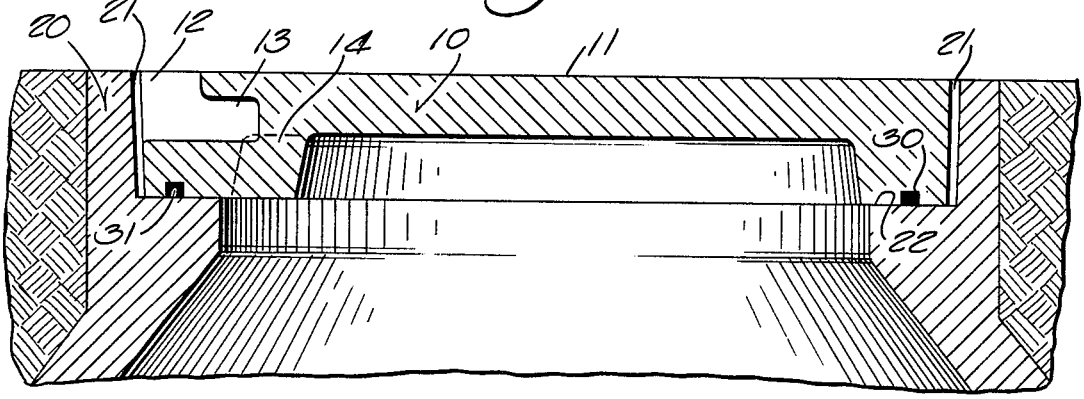
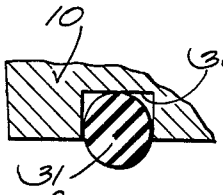
Fig. 2
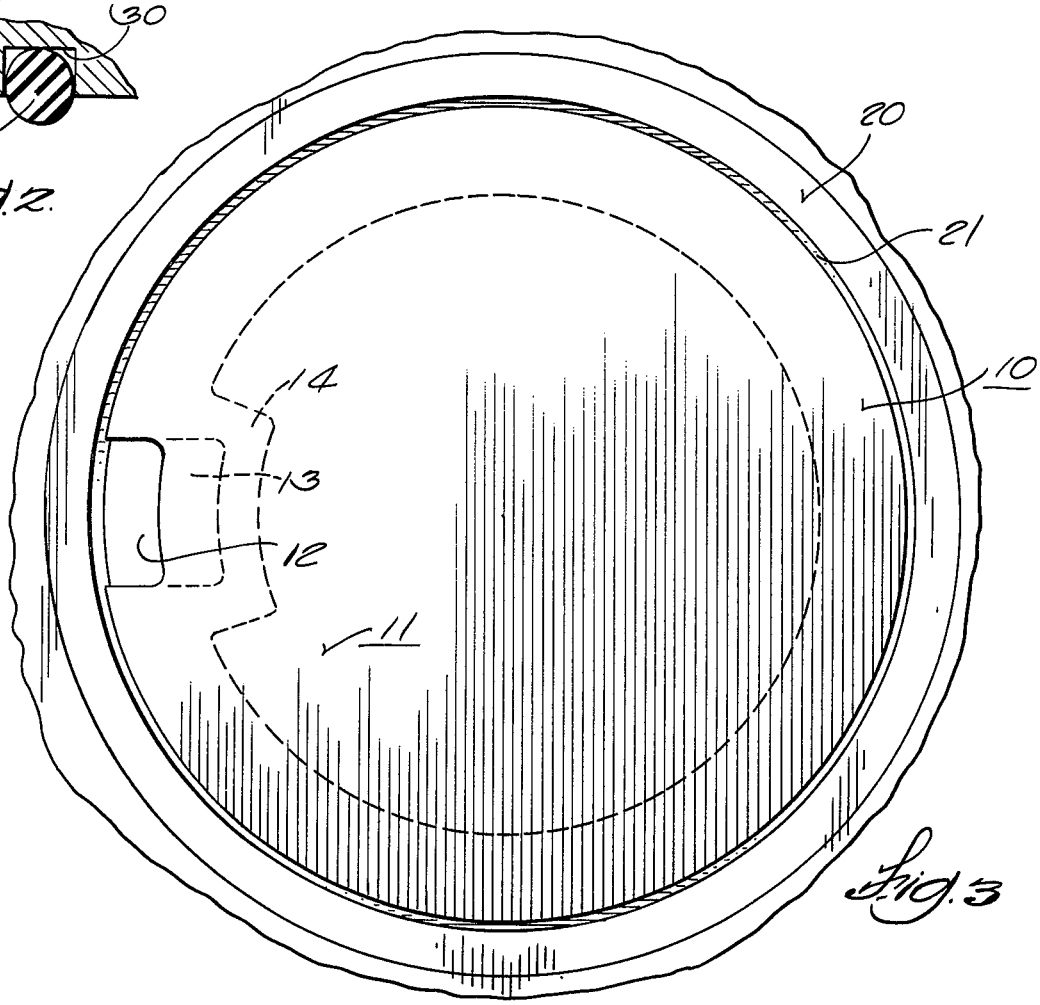
Fig. 3

SEALING MANHOLE COVER FOR USE ON EXISTING UNSEALED SANITARY SEWER MANHOLE COVER FRAMES

BACKGROUND OF THE INVENTION

It has been found that considerable quantities of rain water enter sanitary sewers through the openings conventionally provided in manhole covers. Such covers may or may not have holes specifically for venting gases, but in any case were provided with holes for lifting tools so that they might be removed for access to the sewer. In addition, rain water can enter around the edge of a manhole cover and get into the sewer, because metal to metal contact usually is not sufficiently waterproof to keep it out, particularly if the manhole cover and cover frame have been in service for some time.

SUMMARY OF THE INVENTION

My invention consists of a manhole cover which is adapted to fit into an existing cover frame so that it becomes unnecessary to replace the cover frame, which is imbedded in a paved road, to seal the manhole of a sanitary sewer. I provide a blind hole or slot in the cover to receive a lifting tool, and the lower surface of the cover is provided with an O-ring groove having a rectangular configuration and dimensioned respecting the O-ring to have a depth slightly more than one-half the thickness of the O-ring gasket and a width very nearly the width of the O-ring gasket so that the O-ring is lightly compressively held in place in the groove with a portion beyond the groove when uninstalled, and is under compression when the manhole cover is installed against the horizontal supporting flange of the manhole cover frame. The location of the groove is so chosen as to place the O-ring near the center of the radially inwardly projecting flange of the cover frame which supports the manhole cover and sufficiently far from the edge of the manhole cover to prevent the groove from breaking out if the cover is dropped.

DRAWINGS

FIG. 1 is a cross sectional view on line 1—1 of FIG. 3.

FIG. 2 is an enlarged view of the left side of the manhole cover of FIG. 1.

FIG. 3 is a top plan view of the manhole cover of my design.

DESCRIPTION OF THE INVENTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the inventon, which is defined by the claims.

A manhole cover 10 rests on a conventional manhole cover frame 20 provided with a circular opening 21 to receive manhole cover 10. A ledge of the manhole frame has a horizontal surface 22 at the bottom of opening 21 extending entirely around the opening to receive manhole cover 10. These details of the manhole cover frame are conventional.

My novel manhole cover 10 has a top surface 11 which is unbroken by any opening whatsoever with the exception of a blind hole 12 provided with a recess 13 beneath upper surface 11 to receive a pick or lifting tool. As shown in FIG. 1 the metal of the cover extends at 14 entirely around blind pocket 13 so that there is no opening from surface 11 to the underside of the manhole cover 10.

My manhole cover is provided with an O-ring groove of rectangular configuration 30 in which is an O-ring 31. In a preferred form the O-ring is one quarter inch across the diameter of the circular cross section; the width of the rectangular O-ring groove is 0.21875 inches; and the depth of the O-ring groove is 0.15625 inches. Thus the O-ring fits partially within and partially outside of the O-ring groove when the manhole cover is not in the manhole cover frame, and is under slight compression within the groove. When the manhole cover is placed in the standard manhole cover frame as shown in FIG. 1, the O-ring makes a complete seal with substantially any manhole cover frame, preventing the entrance of rain water and other materials into the sewer from the surface of the street.

Preferably the O-ring groove 30 is at least one-quarter inch from the edge of the manhole cover 10 to prevent breakage of the edge under the rough treatment common with such covers, and generally centered on support flange 22. The dimensions of groove 30 may vary, but a depth of about 3/5 the O-ring cross-section diameter and a width about 85% of such diameter for a compression fit and a projecting O-ring have been found suitable.

It is of course contemplated that the precise dimensions may differ but that the general proportions will be preserved at least to the extent necessary so that the O-ring will remain in its slot while the manhole cover is not installed, and will make a reliable seal with a reasonably clean flange 22 of a manhole cover frame when the cover is installed. The dimensions specified have been found appropriate to carry out these functions.

I claim:

1. A manhole cover for reception in a conventional manhole cover frame having a horizontal flange extending peripherally around an opening, said manhole cover having a horizontal peripheral portion adapted to rest on said ledge, the novelty comprising, an imperforate upper surface of said cover extending entirely across the cover broken only by a blind pocket to receive a manhole opening tool, and an O-ring groove extending around the lower surface of said horizontal peripheral portion of said cover at a location such that when the cover is installed in a standard manhole cover frame the O-ring groove will be located over the horizontal flange of a said frame, said groove being downward opening and rectangular in radial cross section, and spaced inwardly from the periphery of said cover, and an O-ring having a generally circular radial cross section with a diameter sufficiently greater than the radial width of said groove that said O-ring must be compressed slightly to place it in the groove, said groove having a vertical depth slightly more than half the diameter of the O-ring whereby the O-ring is retained in said groove by compression of its diameter and has a portion projecting downwardly from the groove whereby to engage the flange of a said manhole cover frame when said manhole cover is installed in a said frame.

2. The device of claim 1 in which the depth of said groove is on the order of 3/5 of the diameter of the cross section of said O-ring and the width of said O-ring groove is on the order of 85% of the diameter of the cross section of said O-ring.

3. The device of claim 1 in which said O-ring groove is circular and is spaced from the periphery of the circular manhole cover a distance sufficient so that when said manhole is installed in a said manhole cover frame the O-ring will be approximately centered on the horizontal flange of a said manhole cover frame.

4. The device of claim 1 in which the O-ring groove is spaced not less than a quarter of an inch from the margin of the manhole cover whereby to tend to prevent breakage of the edge of the manhole cover if the cover is mistreated.

* * * * *